US009595367B2

(12) United States Patent
Maritano et al.

(10) Patent No.: US 9,595,367 B2
(45) Date of Patent: Mar. 14, 2017

(54) HIGH VOLTAGE DIRECT CURRENT CABLE HAVING AN IMPREGNATED STRATIFIED INSULATION

(75) Inventors: Mauro Maritano, Milan (IT); Gianni Miramonti, Milan (IT)

(73) Assignee: PRYSMIAN S.P.A., Milan (IT)

( * ) Notice: Subject to any disclaimer, the term of this patent is extended or adjusted under 35 U.S.C. 154(b) by 609 days.

(21) Appl. No.: 13/515,420

(22) PCT Filed: Dec. 16, 2009

(86) PCT No.: PCT/IB2009/007769

§ 371 (c)(1),
(2), (4) Date: Jul. 23, 2012

(87) PCT Pub. No.: WO2011/073709

PCT Pub. Date: Jun. 23, 2011

(65) Prior Publication Data

US 2012/0285725 A1 Nov. 15, 2012

(51) Int. Cl.
*H01B 13/00* (2006.01)
*H01B 3/52* (2006.01)
(Continued)

(52) U.S. Cl.
CPC ..... *H01B 3/52* (2013.01); *H01B 3/54* (2013.01); *H01B 7/0225* (2013.01); *H01B 9/0688* (2013.01)

(58) Field of Classification Search
CPC ..... H01B 3/52; H01B 9/06; H01B 9/0611; H01B 9/0616; H01B 9/0627; H01B 9/0688; H01B 3/54; H01B 7/0225
(Continued)

(56) References Cited

U.S. PATENT DOCUMENTS 3,749,812 A * 7/1973 Reynolds et al. ..... 174/25 R
4,782,194 A 11/1988 Johnsen
(Continued)

FOREIGN PATENT DOCUMENTS

EP 0 684 614 A1 11/1995
EP 0 843 320 A2 5/1998
(Continued)

OTHER PUBLICATIONS

International Search Report issued by the European Patent Office in International Application No. PCT/IB2009/007769, mailed Sep. 17, 2010 (3 pages).

*Primary Examiner* — Chau N Nguyen
(74) *Attorney, Agent, or Firm* — Finnegan, Henderson, Farabow, Garrett & Dunner, L.L.P.

(57) ABSTRACT

A high voltage direct current cable includes at least one electrical conductor, at least one semiconducting layer, at least one stratified insulation made from windings of at least one paper-polypropylene laminate, the stratified insulation being impregnated with at least one electrically insulating fluid having a kinematic viscosity of at least 1,000 cSt at 60EC, wherein the laminate includes at least one paper layer having an air impermeability of at least 100,000 Gurley $sec^{-1}$. Such a high air impermeability of the paper layer(s) remarkably reduces the swelling of the polypropylene layer (s) during impregnation with a high viscosity insulating fluid, thus preventing delamination, up to the end of the impregnation process for the whole stratified insulation.

26 Claims, 3 Drawing Sheets

(51) Int. Cl.
*H01B 3/54* (2006.01)
*H01B 7/02* (2006.01)
*H01B 9/06* (2006.01)

(58) Field of Classification Search
USPC ..... 174/25 R, 25 C, 25 G, 25 P, 26 G, 26 R, 174/120 R, 120 SR, 120 FP
See application file for complete search history.

(56) References Cited

U.S. PATENT DOCUMENTS

| | | | | |
|---|---|---|---|---|
| 5,850,055 | A * | 12/1998 | Bosisio et al. | 174/25 R |
| 6,207,261 | B1 | 3/2001 | Kuwabara et al. | |
| 6,395,975 | B1 * | 5/2002 | Bosisio et al. | 174/25 R |
| 2001/0042635 | A1 | 11/2001 | Kondo et al. | |
| 2005/0260427 | A1 * | 11/2005 | Kochem et al. | 428/523 |

FOREIGN PATENT DOCUMENTS

| | | | |
|---|---|---|---|
| EP | 0 933 786 | A1 | 8/1999 |
| GB | 2 196 781 | A | 5/1988 |
| WO | WO 99/33068 | | 7/1999 |

* cited by examiner

HIGH VOLTAGE DIRECT CURRENT CABLE HAVING AN IMPREGNATED STRATIFIED INSULATION

CROSS REFERENCE TO RELATED APPLICATION

This application is a national phase application based on PCT/IB2009/007769, filed Dec. 16, 2009, the content of which is incorporated herein by reference.

BACKGROUND OF THE INVENTION

The present invention relates to a high voltage direct current (DC) cable having an impregnated stratified insulation. More particularly, the present invention relates to a high voltage DC cable having a stratified insulation made from a paper-polypropylene laminate impregnated with an electrically insulating fluid, said cable being suitable for terrestrial or, preferably, submarine installations.

For the purposes of the present description and the appended claims, with the term "high voltage" it is meant a voltage of at least 35 kV. For the purposes of the present description and the appended claims, with the term "very high voltage" it is meant a voltage of at least 200 kV, preferably of at least 300 kV.

Cables with impregnated stratified insulation are known wherein the electrical conductor is electrically insulated by winding thin tapes made from paper or, preferably, from a multilayer paper-polyolefin (typically polypropylene) laminate. The stratified insulation is then thoroughly impregnated with a fluid having high electrical resistivity and a predetermined viscosity, the importance of which will be discussed in the following.

As reported, for example, by U.S. Pat. No. 6,207,261, examples of DC (direct current) and AC (alternate current) impregnated power cables include:

self-contained oil filled (OF) cable impregnated with insulating oil having a relatively low viscosity, supplied from an oil feeding apparatus provided at one or both ends of the cable line so that the insulating layer is kept under a positive pressure by the insulating oil;

high-pressure pipe-type OF (POF) cable deployed by inserting a cable core (assembly of cable conductor/s and insulation) into a steel pipe previously installed, evacuating the steel pipe and filling the steel pipe with an insulating oil having a slightly higher viscosity than that of insulating oil for OF cable;

mass-impregnated (or solid) cable being impregnated with an insulating oil having a higher viscosity than that of insulating oil for POF cable, covered with a metallic sheath.

High voltage direct current (HVDC) mass-impregnated cables are especially useful for long distance power transportation, especially along submarine lines, as from, e.g., U.S. Pat. No. 4,782,194 or WO 99/33068. Besides the advantages provided by the direct current transportation (e.g. with consistently reduced dielectric losses), the HVDC cables do not suffer from fluid migration encountered in mass impregnated HVAC (high voltage alternate current) cables. Oil-impregnated HVAC cables are usually of the above mentioned OF or POF type.

GB 2,196,781 discloses compositions known for impregnating layered insulation for DC cable have a viscosity, at room temperature (20° C.), of from 1000 to 50000 cSt.

The step of impregnating the paper-polypropylene laminate with the fluid is critical. In particular, the semifinished laminated cable core is submerged into the fluid and left to stand for a period typically lasting about 30 days to allow the fluid to penetrate even into the most radially inner layers of laminate. A full and complete penetration of the fluid is of the utmost importance for avoiding a significant reduction of the electrical performance. During impregnation the laminate swells to some extent, the phenomenon being mainly due to the swelling of the polypropylene layer. Such swelling could cause delamination. The possible separation of one layer from the other, even if partial, has extremely serious consequences on the functionality of the cable. Efforts have been made for improving the adhesion between paper and polypropylene to obtain a laminate with an improved resistance to swelling. Features like paper density and permeability, polypropylene cristallinity, special treatment in the manufacturing of the laminate were considered.

The use of a high viscosity fluid, as generally employed for mass-impregnated cables, makes the impregnation process even more critical, as explained hereinunder.

U.S. Pat. No. 5,850,055 relates to an electrical cable for high and very high voltages wherein the conductors are surrounded by a stratified insulation impregnated with an insulating fluid, said insulation being constituted by a paper/polypropylene/paper laminate wherein the central layer is formed by a radiated polypropylene film, i.e. a polypropylene film radiated with high-energy ionizing radiations. The insulating fluid is an oil having a very low viscosity, of the order of 5-15 centistokes, and a resistivity of at least 1016 ohm/cm, such as mineral oils, alkyl naphthalenes and alkyl benzenes. The paper has a low density, typically a maximum density of 0.85 g/cm$^3$, preferably from 0.65 to 0.75 g/cm$^3$. Typically, the paper has an impermeability to air ranging from $10\times10^6$ to $30\times10^6$ Emanueli units (corresponding to (Gurley unit×455)/paper thickness (mm)).

The cable disclosed by the above mentioned patent is impregnated with a low viscosity oil that is not suitable for mass-impregnated cables.

U.S. Pat. No. 6,207,261 relates to an electrical insulating laminated paper comprising one or two sheets of a kraft insulating paper and a plastic film layer of a polyolefin resin integrated by melt extrusion, which has been calendered or supercalendered, whereby the total thickness thereof is from 30 to 200 μm and the proportion of the plastic film layer is from 40 to 90%. Examples of laminates comprising paper with a density of 0.70-0.72 g/cm$^3$ and an air impermeability of 2,500-3,000 sec/100 ml are compared with laminates comprising paper with a density of 1.09-1.13 g/cm$^3$ and an air impermeability of at least 100,000 sec/100 ml (corresponding to 100,000 Gurley sec$^{-1}$). The laminates were subjected to ageing test at a temperature of 100° C. in an alkylbenzene oil (a low viscosity insulating oil) which is used in OF cable for 24 hours. After ageing, the adhesive strength between the paper layers and the polypropylene layer was measured: the comparative specimens using high density and high air impermeability paper showed a very poor adhesive strength and underwent complete peeling of the layers during or after dipping in the alkylbenzene oil.

SUMMARY OF THE INVENTION

The Applicant has faced the problem of improving performance and reliability of high voltage and very high voltage (hereinafter collectively referred to as "high voltage", unless otherwise indicated) direct current cables having an impregnated stratified insulation, wherein impregnation is carried out by using a high viscosity insulating fluid (kinematic viscosity of at least 1,000 cSt at 60° C.). Using an insulating fluid with such a high viscosity is convenient in DC cables and reduces migration of the insulating fluid within the impregnated laminate as a consequence of thermal cycles to which the DC cable is subjected during operation. Uncontrolled migration of the insulating fluid may cause micro-cavities in the stratified insulation, with consequent risks of electrical discharges and therefore of insulation breakdown.

As already said, one of the main causes of breakdown of the mass-impregnated cables is the swelling of the laminate when put in contact with the insulating fluid, particularly swelling of the polypropylene layer which is much more prone to absorbing the hydrocarbons contained in the insulating fluid than the paper layers. Polypropylene swelling may eventually cause delamination: a separation between adjacent layers, even when partial, may cause serious damages which could jeopardize the functionality of the cable.

The Applicant has observed that a critical step which should be carefully controlled to avoid delamination is the step of impregnating the stratified insulation with the insulating fluid. Because of the high viscosity of the latter, such impregnation step is very long and cumbersome, since it requires full immersion of the insulated cable into a tank filled with the insulating fluid, which gradually penetrates through the laminate layers until complete impregnation is achieved. Such process is generally carried out at a temperature in excess of 100° C. for a time of several days or even weeks (typically from 20 to 40 days).

Particularly, the Applicant has realized that a key phase of the impregnation process corresponds approximately to the first ten days of the process itself, during which the external layers of the stratified insulation, which are the first to be contacted by the insulating fluid, are subject to a remarkable swelling, which may hamper the impregnation of the radially internal laminate layers. Therefore, the impregnation process shall be prolonged to allow the most internal laminate layers to be thoroughly impregnated by the insulating fluid. This prolonged time at high temperature could cause a deterioration of electrical and mechanical performance and an excessive swelling of the external laminate insulating tapes.

The Applicant has found that it is possible to improve performance and reliability of a high voltage cable, particularly for direct current applications as described above, by providing a polypropylene/paper laminate with a controlled (reduced) swelling just in the earlier steps of the impregnation process. To achieve the above result, the polypropylene layer is coupled with at least one layer of paper having an air impermeability of at least 100,000 Gurley $sec^{-1}$. Such a high air impermeability (please note that the higher is the value measured as Gurley $sec^{-1}$, the higher is the air impermeability of the paper) has been found to be associated with the ability of the paper to remarkably reduce the swelling of the polypropylene layer(s) during impregnation with a high viscosity insulating fluid. Particularly, a swelling not higher than 1%, preferably not higher than 0.2%, is achieved after immersion of the laminate in an insulating fluid, having a kinematic viscosity of at least 1,000 cSt at 60° C., at a temperature of 120° C. for a time of 240 hours. The ability of such a laminate to maintain a swelling degree within the mentioned acceptable limits prevents delamination up to the end of the impregnation process for the whole stratified insulation. Such a result is achieved without increasing the duration of the impregnation step.

Therefore, according to a first aspect, the present invention relates to a high voltage direct current (DC) cable comprising:

at least one electrical conductor, at least one semiconducting layer, at least one stratified insulation made from windings of at least one paper-polypropylene laminate, said stratified insulation being impregnated with at least one electrically insulating fluid, wherein the at least one electrically insulating fluid has a kinematic viscosity of at least 1,000 cSt at 60° C.;

wherein the laminate includes at least one paper layer having an air impermeability of at least 100,000 Gurley $sec^{-1}$.

DETAILED DESCRIPTION OF THE INVENTION

For the purpose of the present description and of the appended claims, except where otherwise indicated, all numbers expressing amounts, quantities, percentages, and so forth, are to be understood as being modified in all instances by the term "about". Also, all ranges include any combination of the maximum and minimum points disclosed and include any intermediate ranges therein, which may or may not be specifically enumerated herein.

In a preferred embodiment, the cable according to the present invention comprises an inner semiconducting layer disposed between the conductor and the stratified insulation, and an outer semiconducting layer disposed between the insulating layer and an external metal shield.

According to a preferred embodiment, the at least one paper-polypropylene laminate is constituted by a central layer of polypropylene sandwiched between two paper layers.

Preferably, the at least one paper layer has an air impermeability equal to or higher than 100,000 Gurley $sec^{-1}$. More preferably, the at least one paper layer has an air impermeability of from 100,000 to 150,000 Gurley $sec^{-1}$. Air impermeability may be determined according to known techniques, e.g. IEC 554-2 (1977).

Preferably, at least one paper layer is made of kraft paper.

According to a preferred embodiment, the at least one paper layer has a density of at least 0.9 $g/cm^3$. More preferably said density is not higher than 1.4 $g/cm^3$. Advantageously, the at least one paper layer has a density of from 0.9. to 1.2 $g/cm^3$.

As regards polypropylene, this may be selected from:

(a) thermoplastic propylene homopolymers;

(b) thermoplastic copolymers of propylene with at least one comonomer selected from: ethylene, alpha-olefins having from 4 to 10 carbon atoms.

A preferred comonomer in copolymer (b) is ethylene. Preferably, the total amount ethylene in copolymer (b) is from 0.5 to 10 wt %, more preferably from 0.5 to 5 wt %. The propylene homopolymer or copolymer preferably has a value of Melt Flow Index (MFI) of at least 5 g/10', more preferably from 7 to 50 g/10', measured at 230° C./2.16 kg according to ASTM D1238-04C.

The propylene homopolymer or copolymer preferably has a value of melting enthalpy, measured by Differential Scanning calorimetry (DSC) according to Standard ASTM D3417-83, of at least 100 J/g. Preferably, the propylene homopolymer or copolymer has a value of melting enthalpy equal to or lower than 135 J/g, more preferably the melting enthalpy is from 105 to 110 J/g.

The propylene homopolymer or copolymer preferably has a value of swelling, measured as percentage weight increase, when immersed in a T2015 insulating fluid at 90° C. for 168 hours, not higher than 10%. T2015 is a high viscosity insulating fluid, sold by H&R ChemPharm (UK) Ltd., based on a mineral oil added with about 2% by weight of a high molecular weight polyisobutene as viscosity increasing agent.

As regards the electrically insulating fluid suitable for the present invention, it has generally a viscosity of at least 1,000 cSt at 60° C., preferably from 1,100 to 1,200 cSt at 60° C., according to ASTM D 445-09 (2000). The electrical resistivity of such fluid is generally greater than $1\times10^{14}$ Ω m. Fluids of that type generally comprise a naphthenic or paraffinic oil or a synthetic hydrocarbon oil (e.g. polyisobutylene) or a mixture thereof, optionally additioned with at least one viscosity increasing additive in an amount so as to obtain the desired viscosity, usually from 0.5% to 10% by weight, preferably from 1% to 5% by weight. The viscosity increasing additive may be selected, for example, from: high molecular weight polyolefins, e.g. polyisobutenes; polymerized colophonic resins; microcrystalline waxes; elastomers in a subdivided form, e.g. styrene or isoprene rubbers; or mixtures thereof.

The paper-propylene laminate has generally an overall thickness ranging from 50 to 300 μm, preferably from 70 to 200 μm. The polypropylene layer has generally a thickness ranging from 35% to 75%, preferably from 50 to 65%, of the laminate overall thickness.

The present invention is further illustrated with reference to the attached figures wherein.

Figure 1:
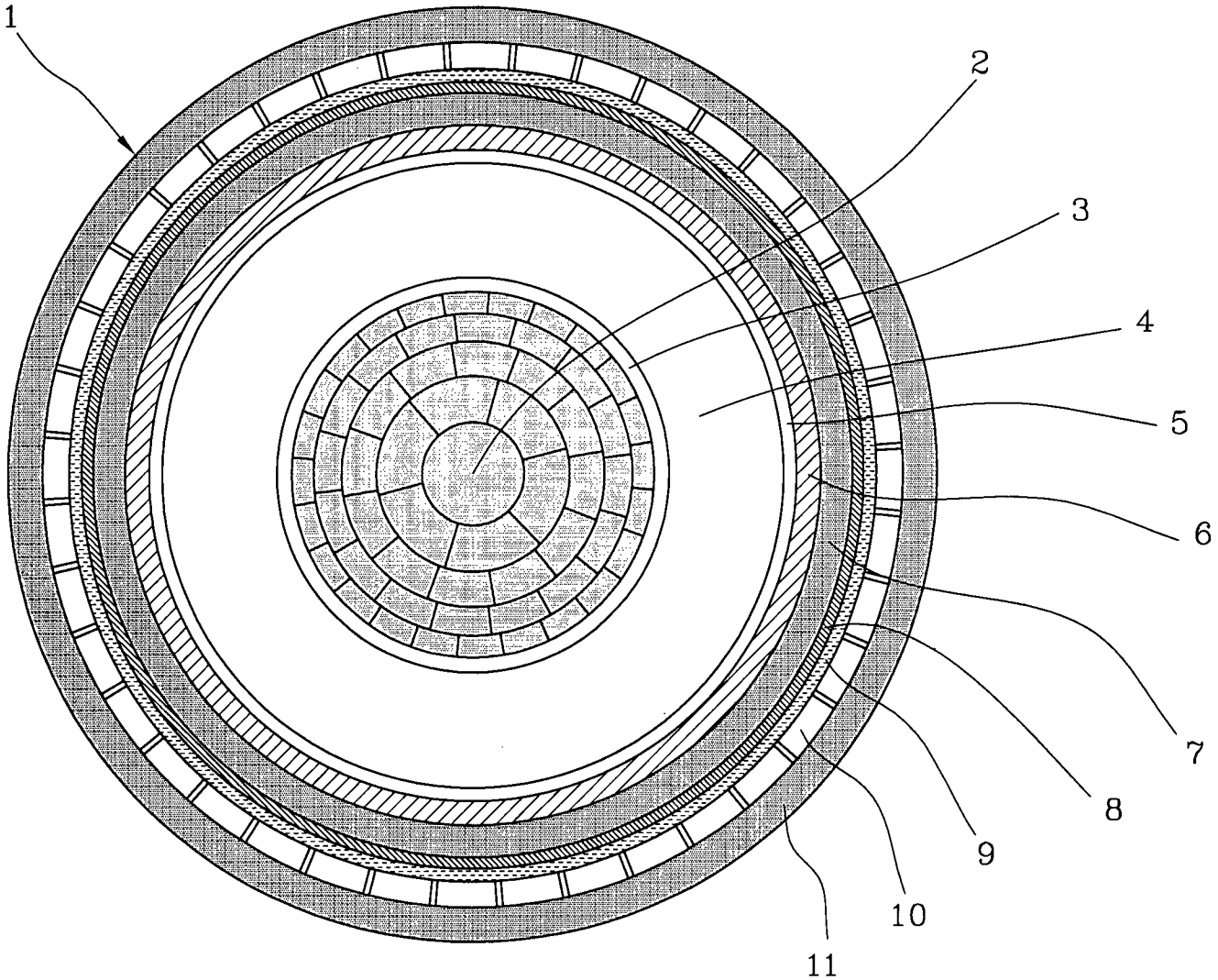
FIG. 1 shows a cross-section view of the cable according to FIG. 1.

With reference to the aforesaid figures, the cable (1) according to the present invention comprises, sequentially from the centre to the exterior, a conductor (2), an inner semiconducting layer (3), a stratified insulation (4), an outer semiconducting layer (5), and a metal sheath (6).

The conductor (2) is generally formed by a plurality of single conductors, preferably made from copper or aluminum, for example in the form of wires stranded together by conventional methods, or, preferably (as illustrated in FIG. 1), the conductor (2) is of the copper shaped or Milliken type.

Around the conductor (2) a layer (3) is placed having semiconducting properties, consisting, for example, of windings of cellulose paper tapes filled with conductive carbon black. Analogous construction can be made for the second semiconductive layer (5) placed around the stratified insulation (4).

The stratified insulation (4) is generally formed by successive windings of the paper-propylene laminate (12) as illustrated above.

The metal sheath (6), usually made from lead or lead alloys, encloses the cable core formed by the aforementioned elements, and any space within the sheath (6) is filled by the insulating fluid so as to thoroughly impregnate the cable layers, particularly the stratified insulation (4).

Around the metal sheath (6), an armoured structure is usually disposed, in order to provide a mechanical protection to the cable. This armoured structure may comprise, for example, a sheath (7) made from a plastic material, on which a metal reinforcement (8), formed e.g. by steel tapes, is placed. Outwardly, at least one armour (10), made e.g. of carbon steel, combined with at least one bedding layer (9), made e.g. of tapes or yarns, may be applied, the bedding layer (9) being able to prevent the armour (10) from damaging the internal layers. As the outermost layer, a serving sheath (11) is usually present, made of polymeric material, provided for protection and uniformity of the cable surface.

Figure 2:
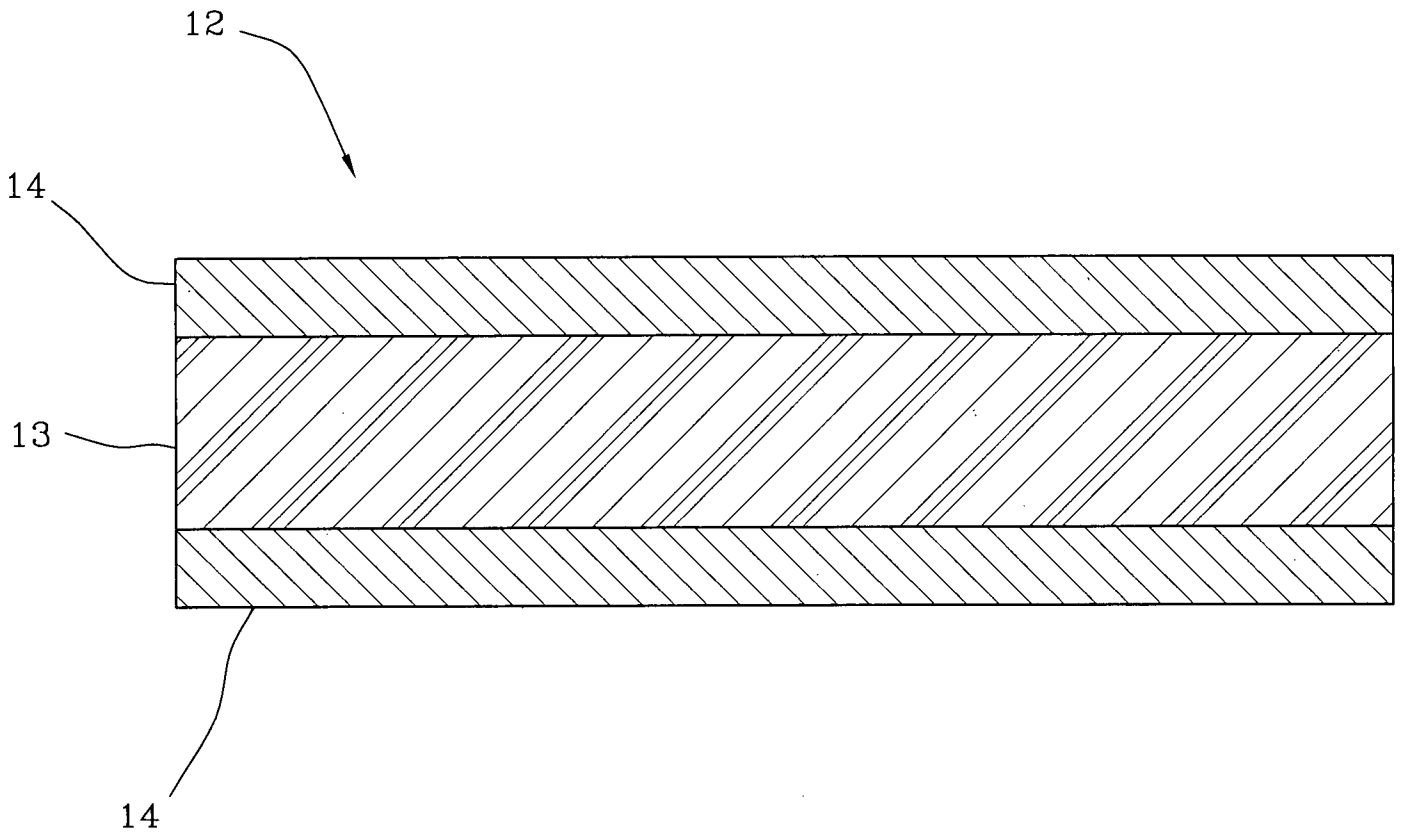
FIG. 2 shows a cross-section view of a laminate according to the present invention.
Figure 3:
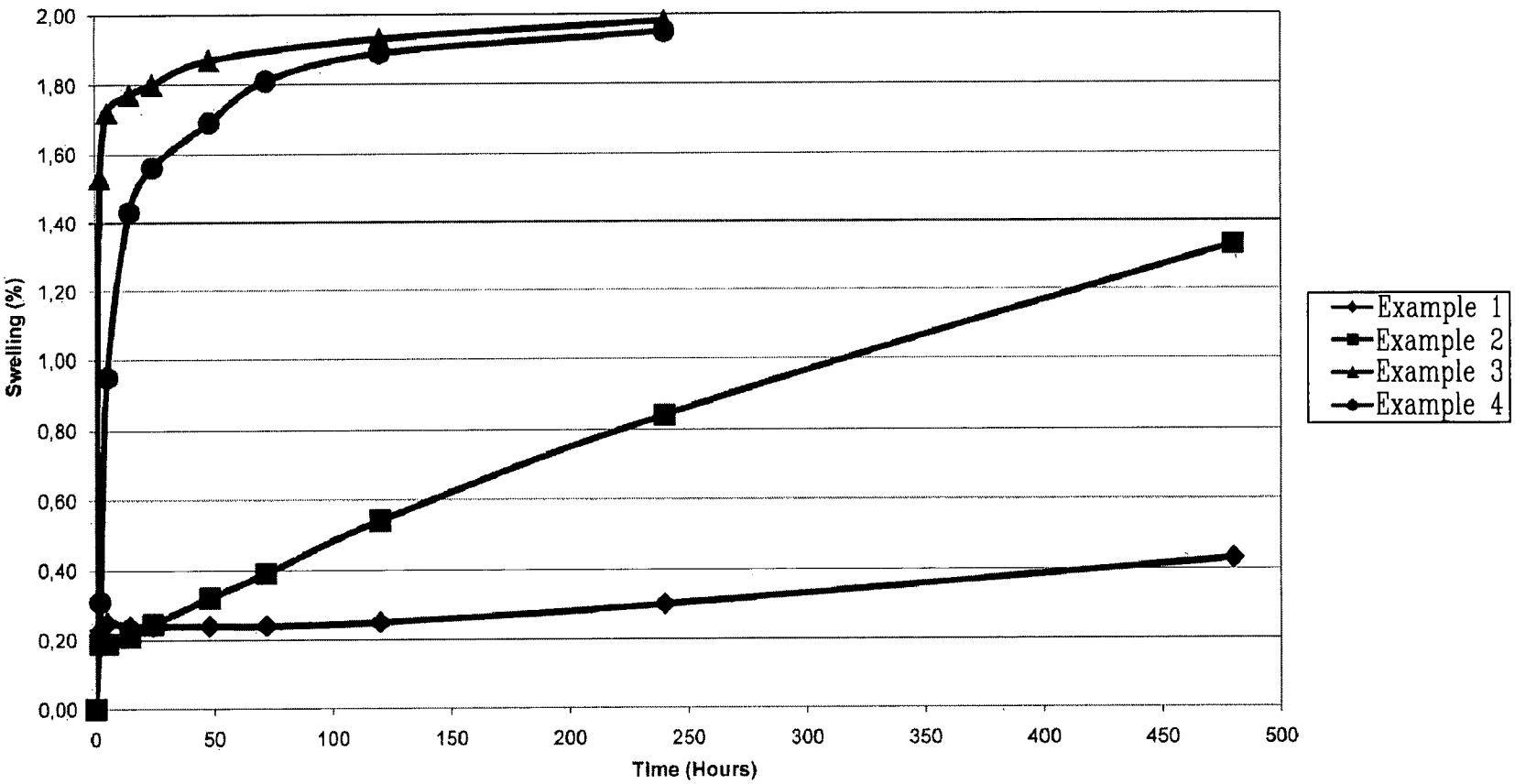
FIG. 3 shows the diagrams of thickness variation over time during impregnation of different laminates with a high viscosity insulating fluid.

FIG. 2 shows a cross-section view of a preferred embodiment of the laminate (12) according to the present invention, wherein a central layer (13) made from polypropylene is sandwiched between two paper layers (14).

The laminate may be manufactured according to known techniques, preferably by extrusion coating wherein the two paper layers (14), usually at room temperature, are put into contact with a film of polypropylene in the melted state, usually at a temperature of from 200° C. to 320° C., namely at a temperature much higher than the melting temperature of the polymer. Afterwards the contacting layers are calendered at low temperatures, usually by means of chilled rolls.

The following working examples are given to better illustrate the invention, but without limiting it.

EXAMPLE 1

Two layers of kraft paper (pure conifer cellulose) having a thickness of 0.025 mm, a density of 0.93 g/ml and an air impermeability of 100,000 Gurley $sec^{-1}$ were coupled with a layer of Pro-Fax™ PF611 (Basell), a propylene homopolymer (PP) having a density of 0.902 g/ml (ASTM D 792) and a MFI @ 230° C./2.16 kg of 30.0 g/10' (ASTM D 1258). The resulting paper/PP/paper laminate had a thickness of 0.100 mm, a PP percentage content of 60% by weight and a weight of 100 $g/m^2$. The peeling strength between PP and paper in the dry laminate was measured according to Standard ASTM D 1876-08 and resulted to be 13 g/15 mm.

The so obtained laminate was dried in an oven under vacuum for 8 hours at 135° C. and then impregnated at 125° C. with an insulating fluid having a viscosity at 100° C. of 1200 cSt (commercial product T2015 by H&R ChemPharm (UK) Ltd.). During the impregnation process, the thickness variation (swelling) was measured at regular intervals: the results are reported in the diagram of FIG. 4. After 240 hours the overall swelling was 0.14%. The peeling strength between PP and paper in the impregnated laminate was measured to be 25 g/15 mm.

By using the above laminate, a cable specimen was produced with a copper conductor of 2000 $mm^2$ cross-section and a stratified insulation of 18.1 mm thickness. After impregnation of the stratified insulation with the same insulating fluid T2015, some tests (bending test based on three repeated cycles and electrical tests, as High Voltage Direct Current with loading cycles up to 1080 kV and impulse test up to 1650 kV) were carried out to check the cable functioning: no shortcoming were encountered.

EXAMPLE 2

Two layers of kraft paper (conifer pure cellulose) having a thickness of 0.025 mm, a density of 0.93 g/ml and an air impermeability of 100,000 Gurley $sec^{-1}$ were coupled with a layer of HD601CF (Borealis), a propylene homopolymer (PP) having a density of 0.90 g/ml (ISO 1183) and a MFI @ 230° C./2.16 kg of 8 g/10' (ISO 1133). The resulting paper/PP/paper laminate had a thickness of 0.100 mm, a PP percentage content of 60% by weight and a weight of 100 $g/m^2$. The peeling strength between PP and paper in the dry laminate was measured according to Standard ASTM D 1876-08 resulted to be 100 g/15 mm.

The so obtained laminate was dried in an oven under vacuum for 8 hours at 135° C. and then impregnated at 125° C. with an insulating fluid having a viscosity at 100° C. of 1200 cSt (commercial product T2015 by H&R ChemPharm (UK) Ltd.).

During the impregnation process, the thickness variation (swelling) was measured at regular intervals: the results are reported in the diagram of FIG. 4. After 240 hours the overall swelling was 0.84%. The peeling strength between PP and paper in the impregnated laminate was measured to be 25 g/15 mm.

EXAMPLE 3 (COMPARATIVE)

Two layers of kraft paper (mixed conifer/broad leaved tree pure cellulose) having a thickness of 0.025 mm, a density of 1.01 g/ml and an air impermeability of 40,000 Gurley $sec^{-1}$ were coupled with a layer of Pro-Fax™ PF611 (Basell), a propylene homopolymer (PP) having a density of 0.902 g/ml (ASTM D 792) and a MFI @ 230° C./2.16 kg of 30.0 g/10' (ASTM D 1258). The resulting paper/PP/paper laminate had a thickness of 0.100 mm, a PP percentage content of 60% by weight and a weight of 100 $g/m^2$. The peeling strength between PP and paper in the dry laminate was measured according to Standard ASTM D 1876-08 and resulted to be 50 g/15 mm.

The so obtained laminate was dried in an oven under vacuum for 8 hours at 135° C. and then impregnated at 125° C. with an insulating fluid having a viscosity at 100° C. of 1200 cSt (commercial product T2015 by H&R ChemPharm (UK) Ltd.). During the impregnation process, the thickness variation (swelling) was measured at regular intervals: the results are reported in the diagram of FIG. 4. After 240 hours the overall swelling was 1.95%. The peeling strength between PP and paper in the impregnated laminate was measured to be 30 g/15 mm.

By using the above laminate, a cable specimen was produced having a copper conductor of 2000 $mm^2$ cross-section and a stratified insulation of 18.1 mm thickness. After impregnation of the stratified insulation with the same insulating fluid T2015, it was found that an excessive swelling of the external windings of the laminate hindered penetration of the insulating fluid through the inner laminate layers, thus causing an unacceptable lack of homogeneity in the insulation impregnation.

EXAMPLE 4 (COMPARATIVE)

Two layers of kraft paper (conifer pure cellulose) having a thickness of 0.025 mm, a density of 0.75 g/ml and an air impermeability of 1,000 Gurley $sec^{-1}$ were coupled with a layer of Pro-Fax™ PF611 (Basell), a propylene homopolymer (PP) having a density of 0.902 g/ml (ASTM D 792) and a MFI @ 230° C./2.16 kg of 30.0 g/10' (ASTM D 1258). The resulting paper/PP/paper laminate had a thickness of 0.100 mm, a PP percentage content of 60% by weight and a weight of 88 $g/m^2$. The peeling strength between PP and paper in the dry laminate was measured according to Standard ASTM D 1876-08 and resulted to be 50 g/15 mm.

The so obtained laminate was dried in an oven under vacuum for 8 hours at 135° C. and then impregnated at 125° C. with an insulating fluid having a viscosity at 100° C. of 1200 cSt (commercial product T2015 by H&R ChemPharm (UK) Ltd.). During the impregnation process, the thickness variation (swelling) was measured at regular intervals: the results are reported in the diagrams of FIG. 4. After 240 hours the overall swelling was 3.5%. The peeling strength between PP and paper in the impregnated laminate was measured to be 30 g/15 mm.

The invention claimed is:

1. A high voltage direct current cable comprising:
- at least one electrical conductor;
- at least one semiconducting layer; and
- at least one stratified insulation made from windings of at least one paper-polypropylene laminate, said stratified insulation being impregnated with at least one electrically insulating fluid,
- wherein the at least one electrically insulating fluid has a kinematic viscosity of at least 1,000 cSt at 60° C., and
- wherein the laminate comprises at least one paper layer having an air impermeability of at least 100,000 Gurley $sec^{-1}$.

2. The cable according to claim 1, wherein the paper-polypropylene laminate has a swelling not higher than 1%, after immersion of the laminate in an insulating fluid, having a kinematic viscosity of at least 1,000 cSt at 60° C., at a temperature of 120° C. for a time of 240 hours.

3. The cable according to claim 2, wherein the paper-polypropylene laminate has a swelling not higher than 0.2%, after immersion of the laminate in an insulating fluid, having a kinematic viscosity of at least 1,000 cSt at 60° C., at a temperature of 120° C. for a time of 240 hours.

4. The cable according to claim 1, comprising an inner semiconducting layer disposed between the conductor and the stratified insulation, and an outer semiconducting layer disposed between the insulating layer and an external metal shield.

5. The cable according to claim 1, wherein the at least one paper-polypropylene laminate comprises a central layer of polypropylene sandwiched between two paper layers.

6. The cable according to claim 1, wherein the at least one paper layer has an air impermeability of 100,000 to 150,000 Gurley $sec^{-1}$.

7. The cable according to claim 1, wherein the at least one paper layer has a density of at least 0.9 $g/cm^3$.

8. The cable according to claim 7, wherein the at least one paper layer has a density not higher than 1.4 $g/cm^3$.

9. The cable according to claim 7, wherein the at least one paper layer has a density of 0.9 to 1.2 $g/cm^3$.

10. The cable according to claim 1, wherein the polypropylene is selected from:
- (a) thermoplastic propylene homopolymers; and
- (b) thermoplastic copolymers of propylene with at least one comonomer selected from: ethylene and alpha-olefins having from 4 to 10 carbon atoms.

11. The cable according to claim 10, wherein, in the thermoplastic copolymer, the comonomer is ethylene.

12. The cable according to claim 11, wherein the total amount of ethylene in the thermoplastic copolymer is 0.5 to 10 wt %.

13. The cable according to claim 12, wherein the total amount of ethylene in the thermoplastic copolymer is 0.5 to 5 wt %.

14. The cable according to claim 12, wherein the propylene homopolymer or thermoplastic copolymer has a Melt Flow Index of 7 to 50 g/10', measured at 230° C./2.16 kg according to ASTM D1238-04C.

15. The cable according to claim 11, wherein the polypropylene homopolymer or thermoplastic copolymer has a melting enthalpy of at least 100 J/g, measured by Differential Scanning Calorimetry according to Standard ASTM D3417-83.

16. The cable according to claim 15, wherein the melting enthalpy of the polypropylene homopolymer or thermoplastic copolymer is equal to or lower than 135 J/g.

17. The cable according to claim 15, wherein the melting enthalpy of the polypropylene homopolymer or thermoplastic copolymer is 105 J/g to 110 J/g.

18. The cable according to claim 10, wherein the propylene homopolymer or thermoplastic copolymer has a Melt Flow Index of at least 5 g/10', measured at 230° C./2.16 kg according to ASTM D1238-04C.

19. The cable according to claim 1, wherein the polypropylene has a value of swelling, measured as percentage weight increase, when immersed in a T2015 insulating fluid at 90° for 168 hours, not higher than 10%.

20. The cable according to claim 1, wherein the at least one electrically insulating fluid has a viscosity of at least 1,000 cSt at 60° C. according to ASRM D 445-09 (2000).

21. The cable according to claim 20, wherein the at least one electrically insulating fluid has a viscosity of 1100 to 1200 cSt at 60° C. according to ASTM D 445-09 (2000).

22. The cable according to claim 20, wherein the at least one electrically insulating fluid comprises a naphthenic or paraffinic oil or a synthetic hydrocarbon oil or a mixture thereof, and optionally, at least one viscosity increasing additive in an amount so as to obtain the desired viscosity.

23. The cable according to claim 1, wherein the paper-polypropylene laminate has an overall thickness of 50 to 300:m.

24. The cable according to claim 23, wherein the paper-polypropylene laminate has an overall thickness of 70 to 200:m.

25. The cable according to claim 1, wherein the polypropylene layer has a thickness of 35% to 75% of the laminate overall thickness.

26. The cable according to claim 25, wherein the polypropylene layer has a thickness of 50 to 65% of the laminate overall thickness.

* * * * *